United States Patent [19]

Hager et al.

[11] Patent Number: 4,798,114

[45] Date of Patent: Jan. 17, 1989

[54] CUTTING UNIT FOR A MEAT SLICING APPARATUS

[75] Inventors: Juergen Hager, Hueckeswagen; Walter Vieth, Wermelskirchen; Werner Manderla, Remscheid, all of Fed. Rep. of Germany

[73] Assignee: Magurit Gefrierschneider GmbH, Remscheid-Lennep, Fed. Rep. of Germany

[21] Appl. No.: 52,948

[22] Filed: May 21, 1987

[30] Foreign Application Priority Data

May 22, 1986 [DE] Fed. Rep. of Germany ... 8613821[U]

[51] Int. Cl.[4] ..... B26D 1/09

[52] U.S. Cl. ..... 83/522; 83/214; 83/255; 83/391; 83/404.1; 83/408; 83/468; 83/550

[58] Field of Search ..... 83/522, 468, 467 R, 83/550, 213, 255, 404.1, 44, 45, 212.1, 214, 391, 408, 437, 549, 703

[56] References Cited

U.S. PATENT DOCUMENTS

| | | | |
|---|---|---|---|
| 1,580,932 | 4/1926 | Thomas et al. | 83/522 X |
| 2,358,223 | 9/1944 | Folk | 83/522 X |
| 2,538,906 | 1/1951 | Ives | 83/213 |
| 2,583,595 | 1/1952 | Rodel et al. | 83/404.1 X |
| 2,592,832 | 4/1952 | Strand | 83/467 |
| 2,807,299 | 9/1957 | Steinmetz | 83/404.1 X |
| 2,815,782 | 12/1957 | Falz | 83/467 |

FOREIGN PATENT DOCUMENTS

| | | |
|---|---|---|
| 0192039 | 8/1986 | European Pat. Off. . |
| 456121 | 2/1928 | Fed. Rep. of Germany . |
| 817350 | 7/1949 | Fed. Rep. of Germany . |
| 2437701 | 2/1975 | Fed. Rep. of Germany . |
| 2605234 | 8/1977 | Fed. Rep. of Germany . |

*Primary Examiner*—Donald R. Schran
*Assistant Examiner*—Eugenia A. Jones
*Attorney, Agent, or Firm*—Cushman, Darby & Cushman

[57] ABSTRACT

An apparatus for cutting meat blocks which includes a main blade to cut slices from a meat block and transverse blades to divide the slice into strips. The blades are mounted on a cutting unit which may be driven to reciprocate relative to a stationary meat block support. The latter includes a slice support structure that extends outwardly beneath the cutting unit in a comb-like configuration. The cutting unit carries a horizontally adjustable stop assembly having stop elements which fit and reciprocate within the gaps formed in the slice support. This configuration permits the smooth and stepless adjustment of the slice thickness without the necessity of disassembling any parts.

11 Claims, 2 Drawing Sheets

CUTTING UNIT FOR A MEAT SLICING APPARATUS

FIELD OF THE INVENTION

The present invention relates to a meat cutting apparatus, and in particular to the cutting unit thereof.

BACKGROUND OF THE INVENTION

European Patent Application No. 86 100 459.6, filed on Jan. 15, 1986, discloses a cutting unit for a meat cutting apparatus. The apparatus comprises a stationary table for supporting the meat, which is usually in the form of a block of deep frozen meat, the table having a transverse end edge that forms a counterblade for a vertically reciprocating main blade that extends parallel to the support table end edge. The cutting unit further comprises a plurality of transverse blades. The main blade cuts a slice from the block, and the transverse blades then divide that slice into a plurality of strips. For this purpose, the transverse blades are mounted adjacent that side of the main blade which faces away from the counterblade, and they reciprocate together with the main blade. The transverse blades have free ends which engage the main blade face at the side referred to above and somewhat above its cutting edge. Beneath the transverse blades are stationary slice support members between the paths of movement of the transverse blades.

The disclosure of the above identified European Patent Application is incorporated herein by reference.

The prior art referred to above also includes a stop member which is engaged by the meat block when the meat is advanced beneath the cutting unit. The stop member is mounted at the cutting unit and thus reciprocates vertically therewith. Theoretically, the slice thickness may be varied, but this would involve the dismantling of all transverse blades prior to the readjustment of the stop member followed by the re-assembly of the transverse blades. Accordingly, varying slice thickness is not easily accomplished.

It is the object of the present invention to provide an improved apparatus of the type mentioned above but wherein the slice and strip thickness is readily adjustable without the necessity of disassembling any part of the apparatus.

SUMMARY OF THE PRESENT INVENTION

According to the present invention, the reciprocating cutting unit also carries a stop member beneath the transverse blades, the stop member including stop elements that will be engaged by the meat block. The stop elements extend into the move within the cutouts or gaps provided in the stationary slice support as the cutting unit moves vertically toward and away from its lowermost position. Accordingly, the slice support and the stop elements interengage in a comb-like fashion. It is preferred to have the stop member adjustable between a variety of thicknesses, and for this purpose, a spindle-and-nut drive system may be provided to permit the ready and easy adjustment thereof. Once adjusted, the stop member is preferably locked, e.g. by clamping means.

A scale grid permits the easy reading of the slice thickness actually selected.

Other objects, features, and characteristics of the present invention, as well as the methods, operation and functions of the related elements of the structure, and to the combination of parts and economies of manufacture, will become apparent upon consideration of the following description and the appended claims with reference to the accompanying drawings, all of which form a part of the specification, wherein like reference numerals designate corresponding parts in the various figures.

BRIEF DESCRIPTION OF THE DRAWINGS

A preferred embodiment of the invention is illustrated in the drawings which are as follows.

DETAILED DESCRIPTION OF THE PREFERRED EMBODIMENT

Figure 1:
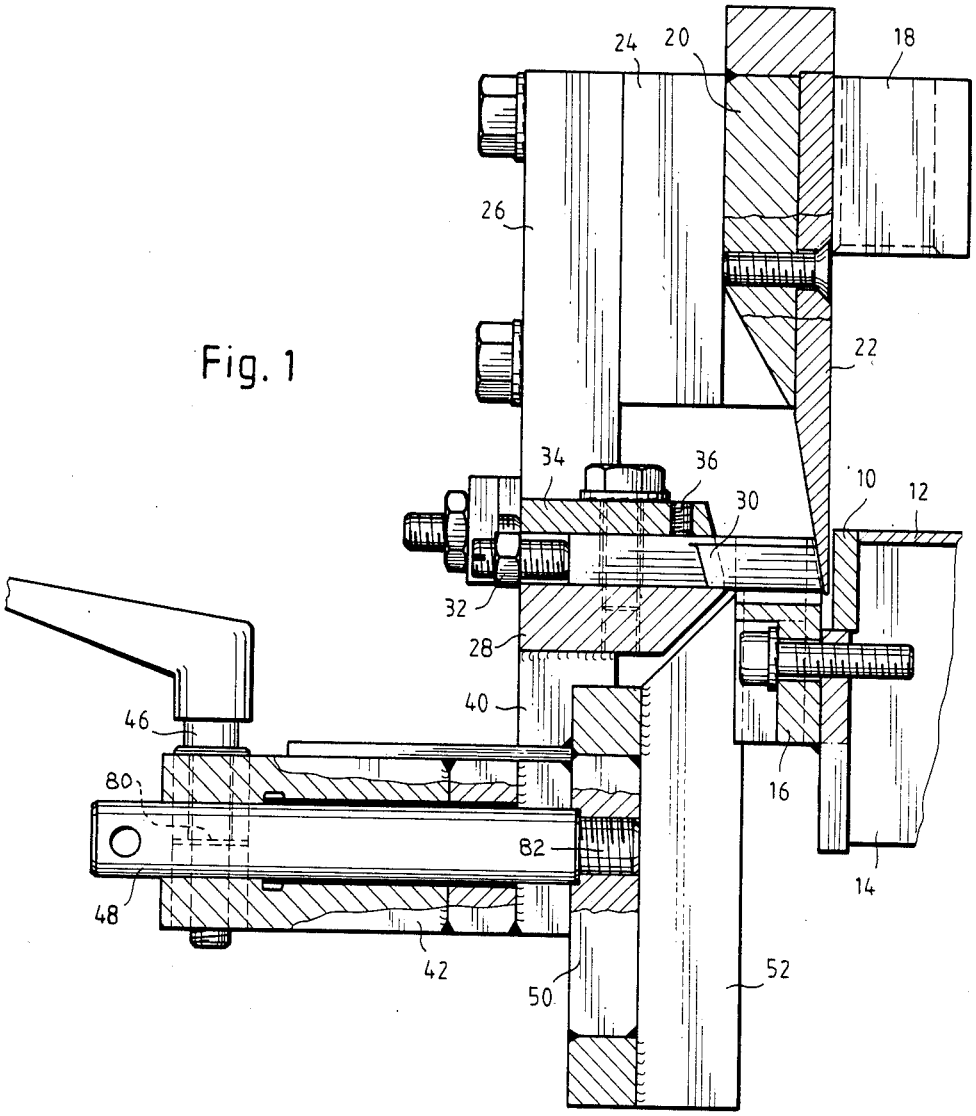
FIG. 1 is a vertical sectional view of a portion of the apparatus including the cutting head.
Figure 2:
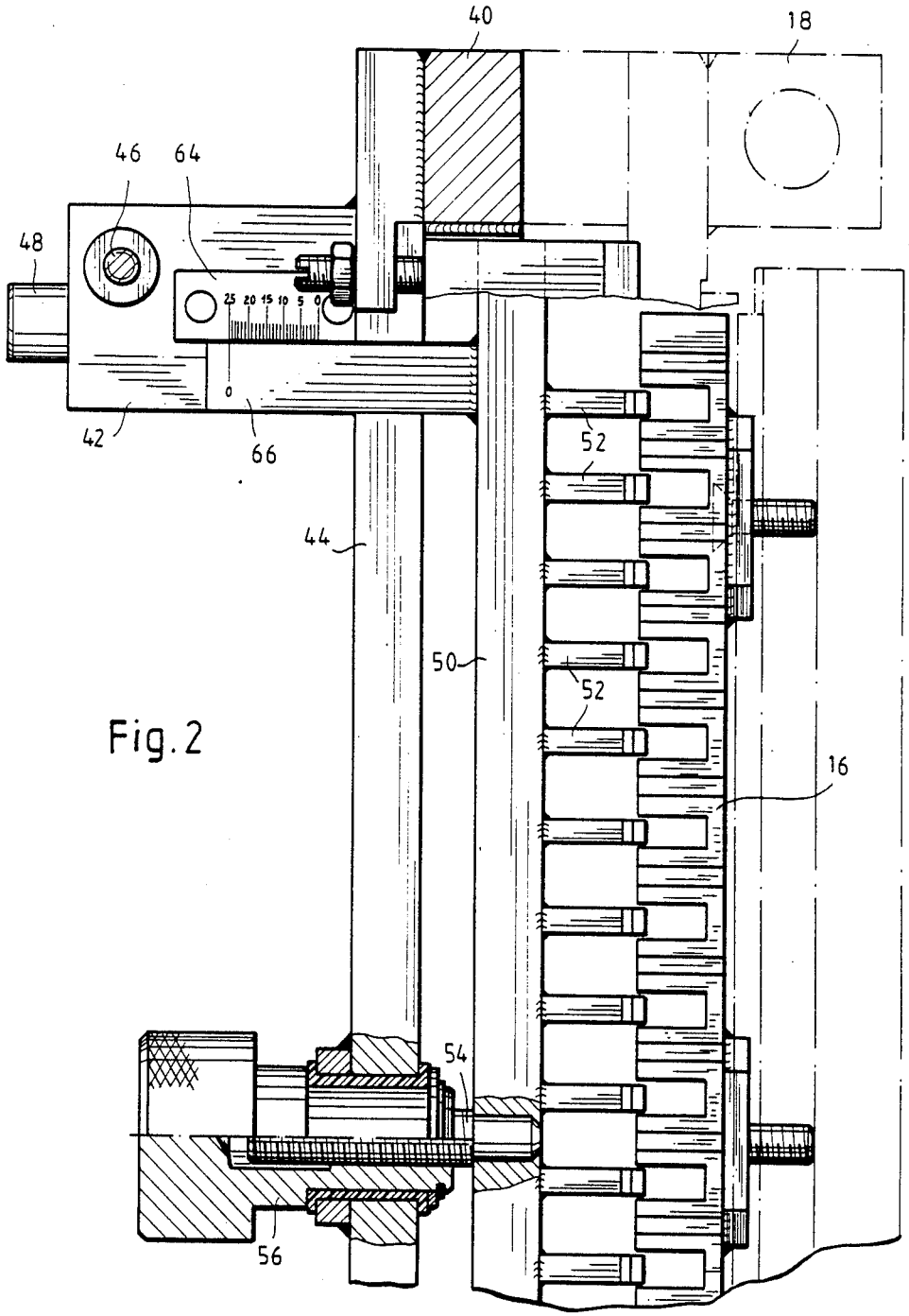
FIG. 2 is a plan view, partly in section, of the same portion of the appartus, with parts broken away for clarity.

Referring first to FIG. 1, the cutting unit is shown in its lowermost position, i.e. at the end of its downward stroke, relative to the stationary members of the apparatus. Those stationary members include a counter blade 10 with a counter cutting edge positioned at the end of a meat supporting table 12 which forms a part of the apparatus frame 14. A slice support 16 is rigidly mounted on frame 14 and has an overall L-shaped section. The slice support 16 also has a comb-like configuration when seen from above as shown in FIG. 2, with gaps or spaces being provided between the plurality of projections forming that comb-like configuration.

The cutting unit may be driven so that it can be vertically reciprocated by conventional means that are well known and, therefore, not shown; conventionally, hydraulic cylinders are used for this purpose but any one of a variety of driving devices could also be used. The cutting unit is slidably guided by means of sleeve members 18 which slide along stationary columns (not shown).

The cutting unit itself includes a main blade carrier 20 to which the main blade 22 is bolted or otherwise fastened such as by the screws shown in FIG. 1. Further, transverse blade carrier 26 (broken away in FIG. 2) is bolted to main blade carrier 20 and spaced from the main blade 22 by spacer members 24.

Transverse blade carrier 26 has welded thereto a support plate 28 provided with slots to receive transverse blades 30; the transverse blades are individually, horizontally adjustable by means of adjustment screws 32 and grub or set screws 36 threaded into threaded holes of a cover plate 34 which, in turn, is bolted to support plate 28 as shown in FIG. 1.

The transverse blade carrier 26 has two depending projections 40 positioned laterally with respect to the length of main blade carrier 20 and thus to main blade 22. Further, a guide sleeve holder 42 is welded to each of the depending projections 40. As shown in FIG. 2, the two holders 42 are transversely connected together by a beam 44 welded thereto.

Each holder 42 has a through hole to receive a guide sleeve, and each is slotted adjacent its free outer end as indicated at 80 on FIG. 1 so that a guiding bar 48 received in the guide sleeve and slidably displaceable relative thereto may be clamped therein by means of a clamping bolt 46 that extends vertically through each holder 42 adjacent the free outer end whereby the slot can be closed about guide bar 48.

Each of the cylindrical guide bars 48 is fixed by means of its threaded end 82 in a plate member 50 to which stop members 52 are welded. There is a stop member for each gap defined within the stationary slice support 16, and the width of members 52 is such that they each just mate with only a small clearance within their respective gap.

A threaded spindle 54 is screwed into plate member 50 and cooperates with a knurled adjustment nut 56 rotatably mounted in beam 44. Once the clamping of the guide bars 48 is released by unscrewing clamping bolts 46, the assembly including plate 50, stop members 52, guide bars 48 and spindle 54 may be displaced horizontally by rotating adjustment nut 56 which moves this whole assembly toward or away from the support table 12. The maximum slice thickness is defined by engagement of the free end of spindle 54 at the inner end face of nut 56 (FIG. 2 illustrates the stop assembly near said outermost position). In the innermost position of the assembly, the stop members 52 engage stationary slice support 16.

A small piece of sheet metal 66 is welded to plate 50 and is displaceable therewith; it carries an indicator, such as the '0' line, shown in Fig.2, which permits the accurate reading of the actual slice thickness on a scale 64 disposed on one of the guide sleeve holders 42.

While the invention has been described in connection with what is presently considered to be the most practical and preferred embodiment, it is to be understood that the invention is not to be limited to the disclosed embodiment, but on the contrary, is intended to cover various modifications or equivalent arrangements included within the spirit and scope of the appended claims.

What is claimed is:

1. An apparatus for cutting meat into strips comprising:

a substantially horizontal table for supporting a meat block to be cut, said table having an end edge forming a counter cutting edge, a cutting unit mounted relative to said table so as to be reciprocable along a path extending substantially vertically and including:

a main blade having a cutting edge extending substantially parallel to said counter cutting edge and a plurality of transverse blades having cutting edges extending substantially transverse to said main blade cutting edge and at a side thereof facing away from said table end edge, said apparatus further comprising a stationary slice support mounted adjacent said table and beneath said transverse blades, said slice support having a plurality of projections extending outwardly away from said table defining a plurality of gaps along said slice support into which said transverse blades extend as said cutting unit reciprocates along its vertical path toward and away from its lowermost position, said cutting unit further including a stop assembly having a plurality of stop elements confronting said gaps and displaceable in a substantially horizontal direction so that each stop element engages an allocated gap.

2. An apparatus as set forth in claim 1 wherein said stop assembly further includes adjusting means for adjustably displacing said stop elements relative to said cutting unit.

3. An apparatus as set forth in claim 2 wherein said stop assembly further includes locking means for locking the stop assembly relative to said cutting unit.

4. An apparatus as set forth in claim 2 further including means for reading slice thickness as determined by the actual position of said stop assembly relative to said cutting unit.

5. An apparatus as set forth in claim 2 and including a spindle-and-nut system for displacing said stop assembly.

6. An apparatus as set forth in claim 2 wherein said stop assembly adjusting means includes a plate member and guide means for guiding the displacement of said plate member, wherein said stop elements are mounted so as to extend vertically on said plate member.

7. An apparatus as set forth in claim 6 wherein each stop element fits into an allocated gap with a small clearance.

8. An apparatus as set forth in claim 7 wherein there is a stop element for each one of said plurality of gaps.

9. An apparatus as set forth in claim 6 wherein said plate member further includes cylindrical guide bars mounted thereto, said cutting unit further including means defining guide bores extending therein for slidably receiving said guide bars.

10. An apparatus as set forth in claim 9 wherein said cutting unit further includes means to clamp said guide bars in said guide bores.

11. An apparatus as in claim 1 wherein the free ends of said transverse blades lie in engagement with said main blade and above the cutting edge thereof.

* * * * *